United States Patent [19]

Morel et al.

[11] Patent Number: 4,924,549

[45] Date of Patent: May 15, 1990

[54] ADJUSTABLE STOP

[75] Inventors: Henri Morel, Maule; Jean-Claude Agrimonti, Montreuil; Bernard Massie, Levallois Perret, all of France

[73] Assignee: ITW de France, Beauchamp, France

[21] Appl. No.: 333,407

[22] Filed: Apr. 5, 1989

[30] Foreign Application Priority Data

Apr. 5, 1988 [FR] France ..... 88 04454

[51] Int. Cl.[5] ..... E05F 5/02

[52] U.S. Cl. ..... 16/82; 16/86 R

[58] Field of Search ..... 16/82, 86 R, 86 A

[56] References Cited

U.S. PATENT DOCUMENTS

| | | | |
|---|---|---|---|
| 1,044,412 | 11/1912 | Newton | 16/86 A |
| 1,385,448 | 7/1921 | Harward | 16/86 A |
| 2,929,647 | 3/1960 | Gladstone | 16/82 |
| 3,766,599 | 10/1973 | Ullman, Jr. | 16/257 |
| 4,218,599 | 8/1980 | Garn | 16/86 R |
| 4,319,794 | 3/1982 | Baehor | 16/257 |

*Primary Examiner*—Nicholas P. Godici
*Assistant Examiner*—James Miner
*Attorney, Agent, or Firm*—Schwartz & Weinrieb

[57] ABSTRACT

An adjustable stop which has a socket (1) of which the end surface (2) forms a stop-surface, a housing (3) fitted with holding means for securing the same to a first element (4) and a clamping rod (7) for radially expanding an inner tube portion (6) of the housing (3) so as to lockingly engage the socket (1).

15 Claims, 4 Drawing Sheets

ADJUSTABLE STOP

FIELD OF THE INVENTION

The present invention relates to an adjustable stop, which can be used for example between the bodywork and bonnet or trunk lid of an automobile.

BACKGROUND OF THE INVENTION

A stop of the aforenoted type and which is made from flexible plastic material is already known and comprises a square threaded screw intended to operate in conjunction with a threaded hole defined within the automobile bodywork. The position of the stop-surface of the stop, which corresponds for example to the alignment of a bonnet or a trunk lid with the other elements of the bodywork, can be adjusted by turning the stop, which is maintained at the desired position by means of the deformation which its thread undergoes when it is screwed into the corresponding hole.

The adjustment of this stop, that is to say the adjustment of the bonnet or the trunk lid with respect to the bodywork, requires a relatively long amount of time, even for experienced operators. A predetermined number of turns are actually necessary, and it is very rare that the correct number of turns will be made during the first attempt, so one or more further adjustments are subsequently necessary.

OBJECT AND SUMMARY OF THE INVENTION

The object of the invention is to provide a stop which can be adjusted more quickly. To this end an adjustable stop is proposed, comprising:

a tubular socket of which an annular transverse end surface forms a stop-surface;

a housing provided with holding means for engagement with a first element upon which the stop is to be fixed, comprising an exterior tube and an interior tube arranged co-axially and having, in cross-section over at least a portion of the socket and of the housing respectively, the exterior contour of the interior tube similar to the contour of the socket bore and the bore contour of the exterior tube similar to the exterior contour of the socket, the aforenoted contoured portion of the housing serving to receive the aforenoted contoured portion of the socket between the exterior tube and the interior tube;

a clamping rod intended to be inserted within the bore of the interior tube of the housing, comprising with the interior tube means providing for the clamping rod a locking position at which it produces a radial force intended to be applied to the socket so as to lock it with respect to the housing, and means to maintain it in this locked position;

the stop being intended to be used in a pre-assembled state where the aforenoted portion of the socket is partially inserted between the exterior tube and the interior tube of the aforenoted portion of the housing in an initial starting position from which it can be further inserted in the axial direction, the stop is put into place upon the first element upon which it is then fixed by the housing holding means, a second element intended to bear against the stop is brought against the stop-surface of the socket, and the first and second elements are pushed toward each other, so as to adjust their relative positions, thereby driving the socket into the housing, and subsequently the socket is locked within the housing by bringing the clamping rod into the locking position.

BRIEF DESCRIPTION OF THE DRAWINGS

The features, particulars and advantages of the invention will appear in the course of a description of an exemplary embodiment, which has variants, given below in a non-limiting manner, with reference to the attached drawings, in which like reference characters designate like or corresponding parts throughout the several views, and wherein.

DETAILED DESCRIPTION OF THE ILLUSTRATED EMBODIMENTS

Figure 1:
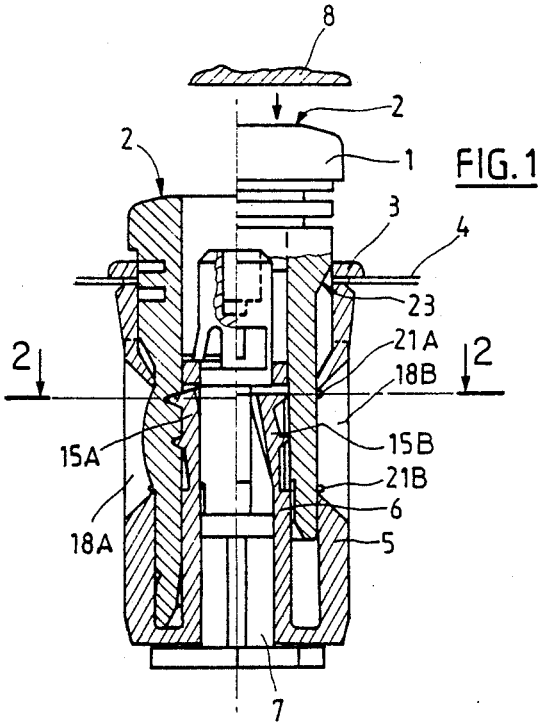
FIG. 1 is a vertical section of a stop contructed according to the invention, the half-section on the right showing the stop in the initial pre-assembled position and the half-section on the left showing the stop after adjustment, having been driven to the minimum height, in the locked position.
Figure 2:
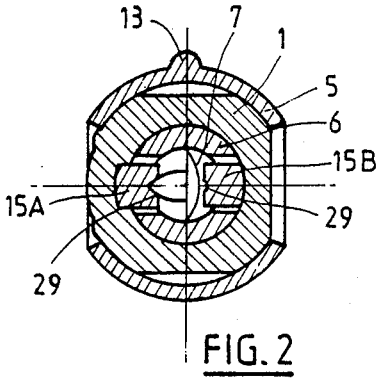
FIG. 2 is a cross-section taken on line II—II in FIG. 1.

As can be seen in FIGS. 1 and 2, the illustrated stop comprises according to the invention a tubular socket 1 of which the annular transverse end surface 2 forms a stop-surface; a housing 3 provided with holding means for retaining the same upon a first element 4—for example the bodywork of a vehicle—upon which the stop is to be fixed, comprising co-axially arranged exterior and interior tubes 5 and 6 and having, in cross-section over at least a portion of the socket and the housing respectively, the exterior contour of the interior tube being similar to the contour of the socket bore and the bore contour of the exterior tube being similar to the exterior contour of the socket, the aforenoted contoured portion of the housing serving to receive the aforenoted contoured portion of the socket between the exterior and interior tubes; and a clamping rod 7 intended to be inserted within the bore of the interior tube 6 of the housing, comprising with this interior tube means providing for the clamping rod a locking position at which it produces a radial force intended to be applied to the socket so as to lock it with respect to the housing, and means to maintain it in this locked position.

The stop is intended to be used in the pre-assembled state shown in the right-hand half section of FIGS. 1 and 2, where the contoured portion of the socket 1 is partially inserted between the exterior tube 5 and the interior tube 6 within the contoured portion of the housing at an initial starting position from which it can be further inserted in the axial direction; the stop is put into place upon the first element 4 at which it is then fixed by the aforenoted housing holding means, a second element 8—for example a bonnet or a trunk lid—intended to bear against the stop is then brought against the socket stop-surface 2, and the first and second elements are pushed toward each other so as to adjust their relative positions, which drives the socket 1 into the housing 3, whereupon the socket is locked within the housing by bringing the clamping rod 7 into the locking position. The stop is therefore in the position shown in the left-hand half-section of FIGS. 1 and 2, if it is assembled to its maximum extent.

Figure 3:
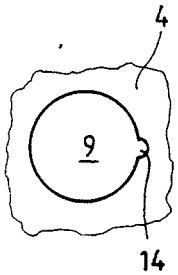
FIG. 3 is a plan view of the aperture for receiving the stop within the first element upon which it is to be fixed.
Figure 5:
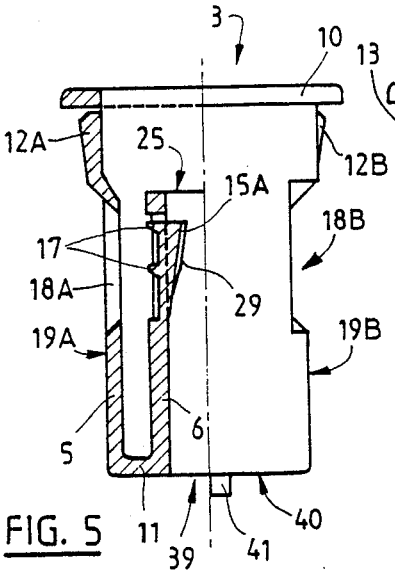
FIG. 5 is a right-side view of this housing, as shown in FIG. 4, in half-section.
Figure 4:
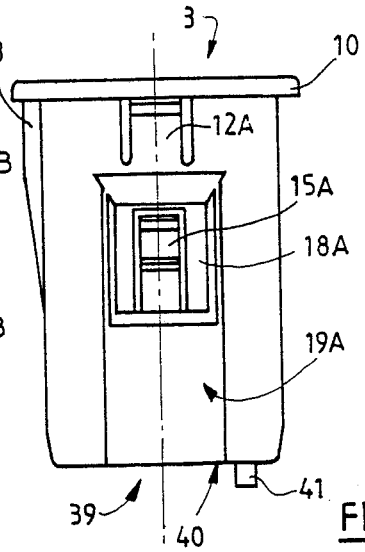
FIG. 4 is an elevation of the housing of the stop.

In this exemplary embodiment, the stop can be mounted by simply inserting it within the assembly aperture 9 of the first element 4 (see FIG. 3). The housing 3 comprises, as its holding means, a flange 10 which surrounds the exterior tube at the end opposite the bottom 11 of the housing, as best seen in FIG. 5, so as to be engaged against the periphery of the assembly aperture 9; and two diametrically opposed resilient holding blades 12A and 12B, each of which is movable through the lateral wall of the exterior tube and which spontaneously has a projecting position with respect to this lateral wall, each blade being intended to bear upon the surface of the first element 4, upon the opposite side to that on which the flange 10 is engaged, as can be seen in FIG. 1; and an anti-rotation spigot 13 (see FIGS. 2 and 4) disposed upon the lateral wall of the exterior tube, for engaging with a corresponding groove 14 of the aperture 9. The spigot prevents rotation of the housing when the clamping rod is turned so as to lock the socket within the housing.

Other ways of preventing rotation are possible in other embodiments in lieu of the spigot, such as, for example using a prismatic aperture 9 instead of a round one, with a corresponding form for the housing zone engaged therewith.

Figure 8:
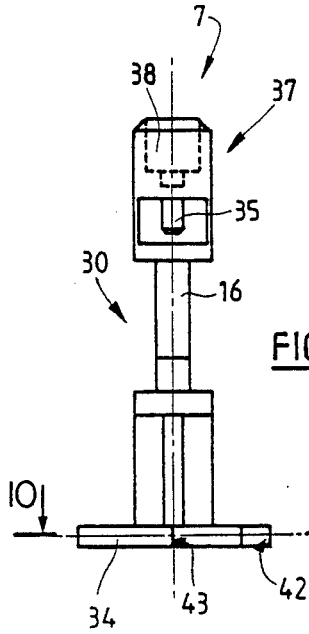
FIG. 8 is an elevation of the clamping rod for the stop.
Figure 10:
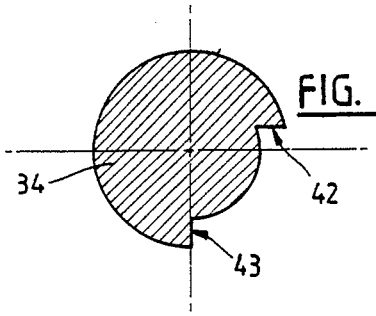
FIG. 10 is a sectional view taken on line X—X in FIG. 8.

The means for providing the clamping rod with a locking position comprises:

for the housing interior tube 6, two diametrically opposed resilient locking blades 15A and 15B, each movable through the lateral wall of the interior tube, and which normally project interiorly into the bore of the interior tube (see FIG. 5 and the right-hand half section of FIGS. 1 and 2);

for the clamping rod 7, a cam 16 adapted to co-operate with the interior projection of each of the resilient blades 15A and 15B, in such a way that when the rod is brought to the locking position, each resilient blade is displaced outwardly in such a way that it has an projects exteriorly with respect to the interior tube, which exerts a radial force upon the socket (see FIG. 8, 9 and the left-hand half-section of FIGS. 1 and 2).

The exterior tube 5 has two diametrically opposed apertures 18A and 18B, each facing the locking blades 15A and 15B, in each of which is engaged a portion of the socket, deformed as a result of the exterior projection of each resilient blade, as can be seen in the left-hand half-section in FIGS. 1 and 2.

Therefore the socket is locked within the housing as a result of interengagement of the surfaces, which is more secure than if the surfaces were simply to bear on each other and adhere together.

In this example transverse sharp teeth 17 are provided upon the part of each locking blade which projects externally, and which are intended to penetrate the socket sidewall in order to improve the locking of the socket within the housing.

Figure 6:
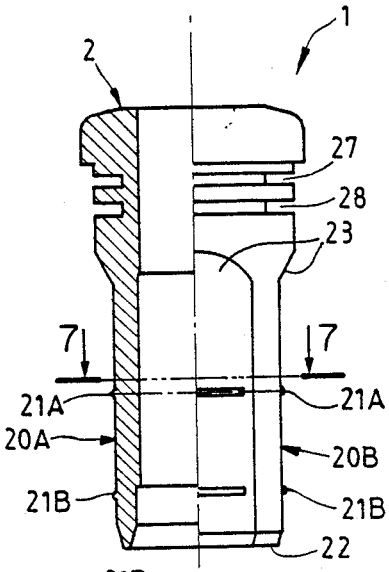
FIG. 6 is a half-section in elevation of the tubular socket for the stop.
Figure 7:
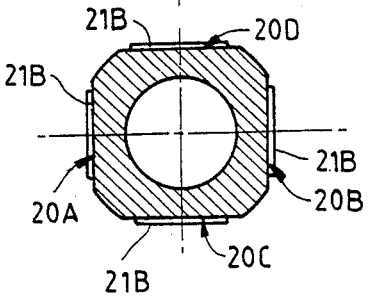
FIG. 7 is a section taken on line VII—VII in FIG. 6.
Figure 9:
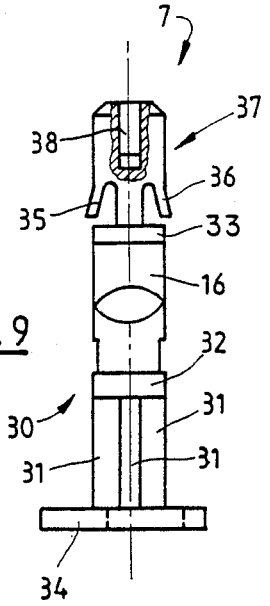
FIG. 9 is a right-side view of the rod as shown in FIG. 8, with a folded section of the cam.

The exterior tube 5 is substantially cylindrical, but has two flat surfaces 19A and 19B within which the apertures 18A and 18B are respectively arranged; and upon the socket 1 there are two corresponding diametrically opposed flat surfaces 20A and 20B, as best seen in FIGS. 6 and 7.

These flat surfaces 20A and 20B give rise to the advantage that the socket lateral wall thickness is reduced within such regions enabling it to be deformed more easily, and furthermore such is favorable for effectively locking the socket within the housing, as the center of the horizontal edges of each aperture (as can be seen in the figures) is then brought closer to the axis of the stop.

In fact, in order to make its introduction into the housing as easy as possible, the socket 1 also has two other diametrically opposed flat surfaces 20C and 20D which correspond to the flat surfaces 20A and 20B, which means that even with the most unfavorable initial angular position of the socket with respect to the housing, only a very small adjustment is necessary in order to arrive at the angular position where the socket can be engaged within the housing.

Each flat surface of socket 1 has two transverse ribs 21A and 21B each of which is intended to engage against a transverse edge of the corresponding apertures (horizontal edges on the figures), in the pre-assembled state of the stop, as can be seen in the right-hand half section in FIG. 1.

This enables the initial position of the socket within the housing to be predetermined before pre-assembling of the stop, as well as maintaining the socket at the initial position.

It is to be noted that the flat surfaces 20A and 20C of the socket extend from its end 22 by which is initially inserted into the housing up to a connection zone 23 which is the region corresponding to the insertion limit of the socket within the housing, in the initial position corresponding to the pre-assembled state of the stop being shown in the right-hand half-section of FIG. 1. Therefore the socket is driven very easily into the housing as long as the connection zone 23 remains above the upper ends of the apertures 18A and 18B, whereas beyond that there is a predetermined resistance which is encountered because of the additional friction between the socket and the housing.

This step enables the socket to be disposed at the initial position within the housing at the time the stop is pre-assembled; in order to arrive at this initial position, it is sufficient to drive the socket into the housing until the aforenoted resistance is encountered. Furthermore it enables the assembly to take place without too much force, while still requiring force to adjust the stop.

The cam 16 of the clamping rod 7 tapers and extends radially from both sides of the rod axis (that is to say diametrically), this rod being intended to be brought by rotation into the locking position for the socket within the housing. More particularly, in connection with the stop pre-assembled state, the cam 16 is inserted between the interior projections of the blades 15A and 15B without acting upon the same (see the right-hand half-sections of FIGS. 1 and 2), but when it is turned, the cam pushes the blades outwardly (see FIGS. 1 and 2).

In this exemplary embodiment, the means by which the clamping rod 7 is maintained at the locking position comprises a locking groove 29 defined within in each locking blade 15A and 15B (see FIGS. 2 and 5) extending in the axial direction, and intended to receive the end of the tapered cam 16 so as to prevent the rotation of the clamping rod.

The interior tube 6 is not as long as the exterior tube 5 and has a cylindrical bore, and the clamping rod comprises:

a body 30 intended to be inserted within the bore of the interior tube 6, comprising the tapered cam 16 and at least one guide surface for the rotation of the rod with respect to the interior tube, for example the ends of the ribs 31, and the narrow cylindrical surfaces 32 and 33 being situated either side of the cam 16;

a transverse head 34 situated upon at one end of the body 30;

at the other end of the body 30, at a distance from the end corresponding to that of the interior tube length, are two resilient locking blades 35 and 36 each of which can move radially and each normally adopting a position projecting beyond the body 30; and a gripping zone 37 extending the rod 7 beyond the blade region, having a groove 38 at the extremity thereof for a tool intended to turn the clamping rod, in this case for a screw-driver with a flat blade.

This rod is rotably mounted within the interior tube 6 by introducing ahead the gripping zone 37 ahead into the interior tube bore through means of the aperture 39 which is defined within the exterior surface 40 of the bottom of the housing, and then inserting the same further into the interior tube bore until the head 34 comes in contact with the exterior surface 40 of the housing 3 and each locking blade 35 and 36 engages the transverse end surface 25 of the interior tube.

It will be noted that the socket, as a result of the ribs 21A and 21B, as well as the clamping rod having the head 34 and the blades 35 and 36, cannot come apart from the pre-assembled state.

The operator, when adjusting the position of the elements 4 and 8, simply inserts the tool (in this case a screw-driver) into the socket bore 1 from above (such as can be seen in the figure), guides the end of the screw-driver into the groove 38 and turns the clamping rod, that is to say through means of a quarter-turn. The socket is therefore locked in the position to which it was adjusted.

The exterior surface 40 of the bottom of the housing has a spigot 41, and the head 34 of rod seven has two abutment surfaces 42 and 43 which are intended to limit the rotation of the clamping rod by engaging the spigot 41, when the clamping rod is respectively disposed at the angular positions for insertion and locking respectively. This ensures, therefore, that when locking the stop the operator does not stop short of or exceed the position at which the end of the cam is engaged in the clamping groove 29, and in this way this also ensures that the initial position in the pre-assembled state is correct.

Figure 11:
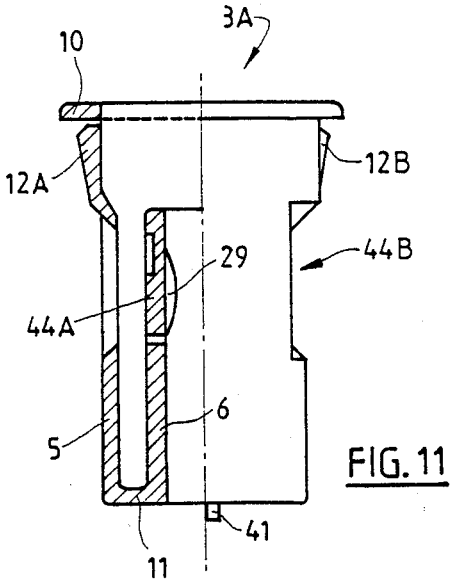
FIG. 11 is a view similar to that of to FIG. 5, for a variant of the housing.

FIG. 11 shows a variant 3A of the stop housing, where the blades 15A and 15B are replaced with comparable diametrically opposed blades 44A and 44B, which are linked in the top section instead of the bottom, and which do not contain teeth 17.

Figure 12:
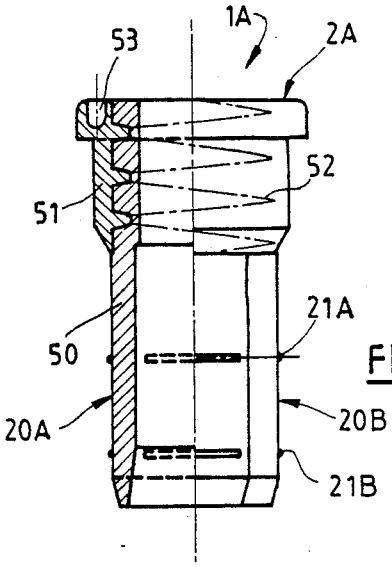
FIG. 12 is a view similar to that of to FIG. 6, for a variant of the socket.

FIG. 12 illustrates a variant 1A of the tubular socket of the stop, which is not all one piece but contains a socket body 50 and socket cap 51 co-operating coaxially with each other by means of their respective threads, the cross-section of which is shown in the left-hand half-section, but which is represented by the primitive spiral 52 in the figure. The surface 2A of the cap 51 includes the annular end surface in the variant, which forms the stop-surface.

The body 50 and the cap 51 are shown in the figure in the pre-assembled state of the stop in a configuration which has been threadly engaged to the maximum amount. When the socket 1A has been locked within the housing in the same way as the socket 1, a final supplementary adjustment of the position of the stop-surface is possible, by turning the cap 51 with respect to the body 50 using the maneuvering slot 53.

The body 50 and the cap 51 are both made of flexible material, and they are secured to each other as a result of the deformation of their threads.

The housings 3 and 3A are made of a relatively hard material whereas the sockets 1 and 1A are made of flexible material. On its lateral wall, next to the stop-surface 2, the socket 1 has annular grooves 27 and 28 which have the effect of making it more flexible (see FIG. 6), which gives it a softening function between the first and second elements 4 and 8 for the shocks caused by the closure impact forces, and also in the case of vibration. Such grooves can, if necessary, also be provided upon the cap 51 of socket 1A.

It will be noted that although two blades 15A and 15B, two flat surfaces 19A and 19B and two holding blades 35 and 36, all diametrically opposed, have been described in the illustrated example for reasons of balance, one of them could be sufficient in other embodiments of the invention; and the cam 16 could therefore simply extend radially instead of diametrically.

Of course the invention is not limited by the embodiment described and shown in the figures, but encompasses all variants which the man skilled in the art can determine.

We claim:

1. An adjustable stop for use between first and second elements, characterized in that it comprises:

a tubular socket (1, 1A) having an interior bore and an annular transverse end surface (2,2A) which forms a stop-surface;

a housing (3,3A) provided with holding means for engaging said first element (4) upon which said stop is to be fixed, and further comprising an exterior tube (5) having an interior bore, and an interior tube (6) arranged co-axially, wherein the exterior contour of said interior tube is substantially similar to the interior contour of said socket bore and the interior contour of said bore of said exterior tube is substantially similar to the exterior contour of said socket, an annular space defined between said tubes of said housing serving to receive said socket between the exterior tube and the interior tube; and a clamping rod (7) disposed within said bore of said interior tube (6) of said housing, comprising, with said interior tube, means providing said clamping rod with a locking position where it produces a radial force intended to be applied to said socket so as to lock said socket with respect to said housing, and means for maintaining said socket in this locked position;

said stop being intended to be used in a pre-assembled state where said socket (1,1A) is partially inserted between said exterior tube (5) and said interior tube (6) of said housing in an initial starting position, from which it can be fully driven into said housing in accordance with an axial force applied thereto, the stop being disposed in place upon said first element (4) upon which it is then fixed by said housing holding means, said second element (8) being intended to bear against said stop as a result of being brought against said stop-surface (2,2A) of said socket, whereby said first and second elements (4,8) are moved toward each other so as to adjust their relative positions and thereby drive said socket (1,1A) into said housing (3,3A), whereupon said socket is locked within said housing by moving said clamping rod (7) to said locking position.

2. A stop according to claim 1, characterized in that said means providing said clamping rod with a locking position, comprises:

upon said housing interior tube (6), at least one resilient locking blade (15A,15B,44A,44B) which can be moved through a lateral wall portion of said interior tube, and which normally projects into said bore of said interior tube; and upon said clamping rod (7), a cam (16) adapted to cooperate with said interior projection of said resilient blade (15A,15B,44A,44B) in such a manner that when said rod is brought to said locking position, said resilient locking blade is displaced outwardly in such a manner that it projects externally with respect to said interior tube, which exerts a radial force upon said socket.

3. A stop according to claim 2, characterized in that said exterior projection of the locking blade (15A, 15B) has transverse sharp teeth (17) intended to penetrate the socket.

4. A stop according to claim 2 characterized in that said cam (16) of the clamping rod (7) is tapered and extends radially, it being intended that said clamping rod is brought into said locking position by rotation.

5. A stop according to claim 4, characterized in that said means for keeping the clamping rod from in the locking position comprise a locking groove (29) arranged on the locking blade (15A, 15B, 44A, 44B) and extending in an axial direction, which is intended to receive the end of the tapered cam (16) to prevent the clamping rod rotating.

6. A stop according to claim 4, characterized in that:

said interior tube (5) and exterior tube (6) in the housing are linked by a transverse bottom (11);

the interior tube (6) is not as long as the exterior tube (5) and has a cylindrical bore;

the clamping rod comprises:

- a body (30), intended to be inserted in the bore of the interior tube, comprising said tapered cam (16) and at least one guide surface (32, 33) for the rotation of the rod with respect to the interior tube;
- a transverse head (34) situated at a first end of the body;
- a second end portion of the body (30) and at a distance from said first end similar to that of the interior tube length, at least one resilient locking blade (35, 36) which is radially movable and normally lies in a position projecting outwardly with respect to the body (30);
- a gripping zone (37) extending the rod (7) axially beyond said second end portion, having a groove (38) at the extremely for a tool intended to turn the clamping rod;

said rod being intended to be mounted for rotation within said interior tube (6) by introducing it with the gripping zone (37) initially being inserted into the interior tube bore through an aperture (39) which is on an exterior surface (40) at the bottom of the housing, said rod then being driven into said interior tube bore until said head (34) comes into contact with said exterior surface (40) of bottom of a housing and the said locking blade (35, 36) engages the transverse end surface (25) of the interior tube, said rod being further intended to be mounted in an angular unlocked position where the cam does not act on the resilient blade of the lateral wall of the interior tube, in said pre-assembled state of the stop.

7. A stop according to claim 6, characterized in that said exterior surface (40) of the housing bottom has a spigot (41), and said head (34) of the clamping rod has two abutment surfaces (42, 43) intended to limit the rotation of the clamping rod by engaging said spigot (41), when the clamping rod is in said unlocked and locked positions respectively.

8. A stop according to claim 2, characterized in that the housing exterior tube (5) has at least one aperture (18A, 18B) facing the locking blade (15A, 15B; 44A, 44B) of the lateral wall of the interior tube, in which a portion of the socket, deformed by said exterior projection of the resilient blade, is intended to be engaged.

9. A stop according to claim 8, characterized in that the exterior tube (5) of the housing is cylindrical but comprises at least one flat surface (19A, 19B) in which said aperture (18A,18B) is arranged, a corresponding flat surface (20A, 20B, 20C, 20D) being provided on the socket.

10. A stop according to claim 9, characterized in that the flat surface (20A, 20B, 20C, 20D) of the socket has two transverse ribs (21A, 21B), each of which is intended to engage a transverse edge of the housing aperture, in said initial position of the socket, disposed within said housing in the pre-assembled state of the stop.

11. A stop according to claim 9, characterized in that the flat surface (20A, 20B, 20C, 20D) of the socket extends from the end by which it is driven into the housing up to a connection zone (23), which is the region corresponding to the insertion limit of the socket in the housing when the socket is inserted further from the initial position corresponding to the pre-assembled state of the stop.

12. A stop according to claim 6, characterized in that said holding means of the housing comprise:

a flange (10) surrounding the exterior tube at the end opposite the bottom (11) of the housing, to be engaged against the periphery of an assembly aperture (9) made in a wall of said first element (4);

at least one resilient holding blade (12A, 12B) which is movable through the lateral wall of the exterior tube and which normally has a projecting position with respect to this lateral wall, the blade (12A, 12B) being intended to bear on said wall of the first element (4), on the opposite side to that on which the said flange engages;

and an anti-rotation spigot (13) disposed on the lateral wall of the exterior tube, intended to be engaged in a corresponding groove (14) of said assembly aperture.

13. A stop according claim 1, characterized in that the said tubular socket (1) is made of flexible material and on its lateral wall, next to the stop-surface (2), has annular grooves which have the effect of making it more flexible (27, 28).

14. A stop according to claim 1, characterized in that said tubular socket (1A) comprises a socket body (50)

and a socket cap (51) which co-operate co-axially by means of screw threads, said cap having said annular transverse end surface (2A) which forms the stop-surface.

15. A stop according to claim 4, characterized in that:

the housing comprises, diametrically opposed:

two locking blades (15A, 15B; 44A, 44B) in the lateral wall of the interior tube, two flat surfaces (19A, 19B) each having an aperture (18A, 18B) facing one of said locking blades, in the lateral wall of the exterior tube, two holding blades, also in the lateral wall of the exterior tube;

the tapered cam of the clamping rod extends diametrically;

the socket has four flat surfaces, diametrically opposed in pairs.

* * * * *